United States Patent [19]

West

[11] 4,120,126

[45] Oct. 17, 1978

[54] PATIO POOL

[75] Inventor: Robert E. West, Yardley, Pa.

[73] Assignee: Cascade Industries, Inc., Edison, N.J.

[21] Appl. No.: 618,104

[22] Filed: Sep. 30, 1975

[51] Int. Cl.[2] ..... E04H 3/16

[52] U.S. Cl. ..... 52/169.7; 4/172

[58] Field of Search ..... 52/169.7; 4/172, 172.19

[56] References Cited

U.S. PATENT DOCUMENTS

| | | | |
|---|---|---|---|
| 2,873,505 | 2/1959 | Sheldon | 52/169 X |
| 3,416,165 | 12/1968 | Pereira | 52/169 X |
| 3,440,780 | 4/1969 | Adam et al. | 52/169 |
| 3,518,704 | 7/1970 | Shanni | 52/169 X |
| 3,735,427 | 5/1973 | Ancewicz et al. | 52/169 X |
| 3,798,857 | 3/1974 | Barrera | 52/169 |
| 3,812,633 | 5/1974 | Shanni et al. | 52/169 |
| 3,815,162 | 6/1974 | Hall | 52/169 X |

*Primary Examiner*—J. Karl Bell

*Attorney, Agent, or Firm*—Frederick A. Zoda; John J. Kane; Albert Sperry

[57] ABSTRACT

A patio pool having an outer wall fixedly mounted on ground level undisturbed earth and an inner wall fixedly mounted to undisturbed earth on the bottom of an excavation, the inner wall extending upward from the excavation to a height such that the top edge thereof is at the same level as the top edge of the outer wall thereby providing a pool whose total depth is partly a result of the excavation depth and partly due to the wall portion extending above ground level, the pool has struts fixedly secured to the inner wall for stabilizing the total wall structure, and a filler material positioned within the space between the inner and outer wall and below a plurality of deck slats connecting the top edges of the inner and outer walls for stabilizing the wall construction.

15 Claims, 5 Drawing Figures

Fig. 1
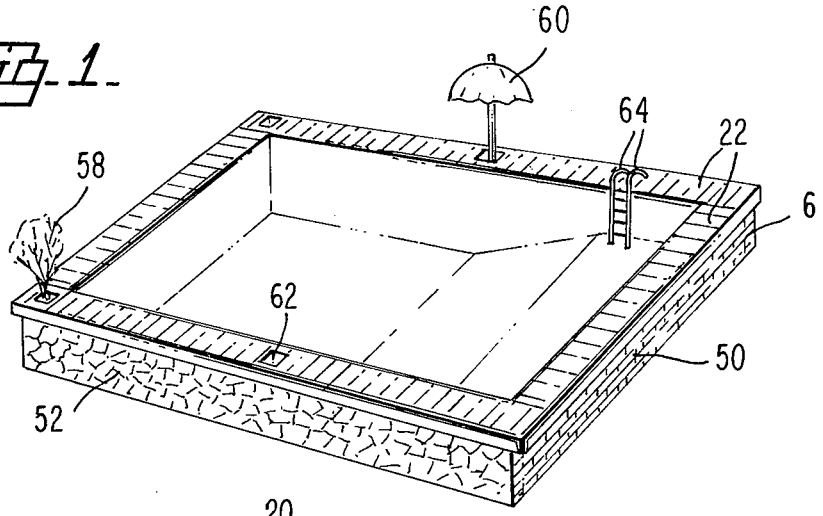
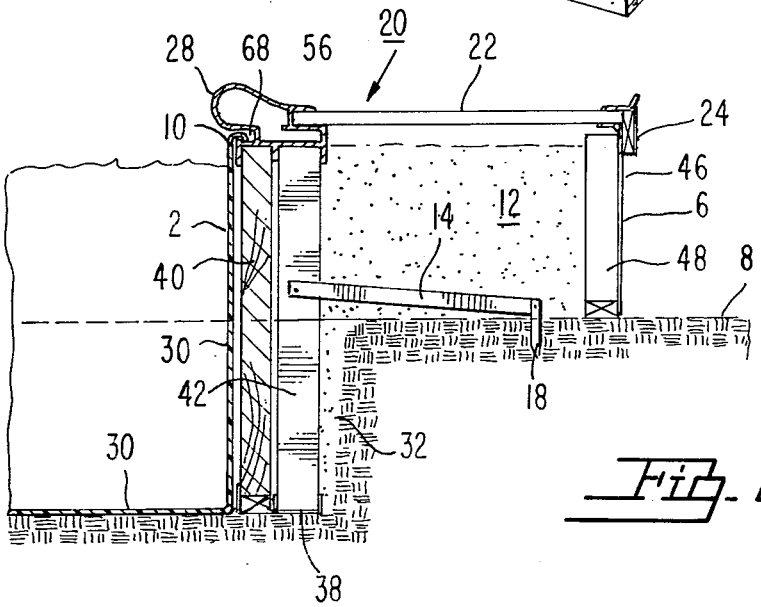
Fig. 2
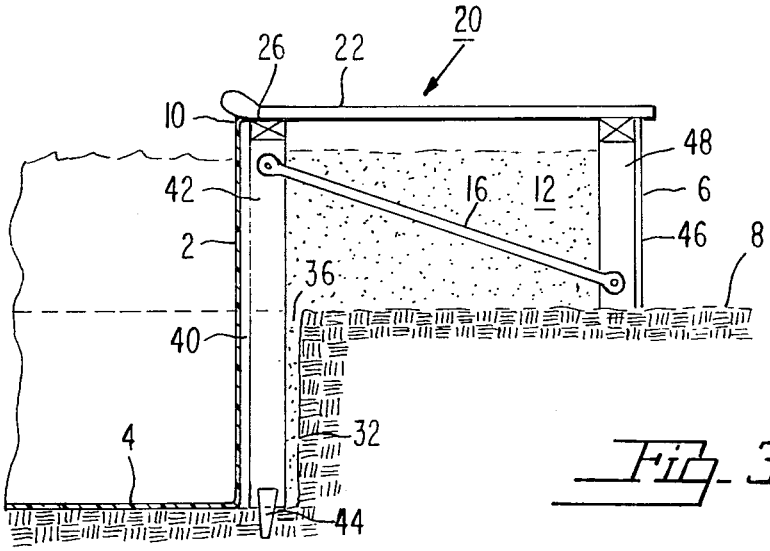
Fig. 3

PATIO POOL

BACKGROUND OF THE INVENTION

1. Field of the Invention

This present invention relates to a swimming pool construction which has all the advantages of above ground pools and all the advantages of below ground pools. Above ground pools are relatively inexpensive and simple to install without the need for experienced installation personnel. Often such pools are easy to dismantle and relocate or modify to the desired depth, width or height. One of the primary advantages of above ground pools is this flexibility in available applications. Also the lack of excavation eases the difficulties of installation or removal and minimizes costs of installation or removel. On the other hand, above ground pools present certain difficulties such as the requirement for very strong wall structure and the limited depths, widths and lengths available.

In ground pools make use of the surrounding earthen wall structure to supply strength to the pool walls such that the strong reinforcing support structures required in above ground pools are not required in under ground pools. Also an in ground pool can be constructed with any reasonably desired dimensions due to the fact that supplemental support structure is not required.

2. Description of the Prior Art

Many construction designs have been devised for above ground swimming pools such as U.S. Pat. No. 3,789,435. Most such designs use prefabricated wall components and unitary vinyl liners. As shown by this patent, the size of the pools are extremely limited due to the tremendous strength required in the wall support structure. As with in ground pools, these pools have various types of coping extending about the upper edge of the walls with a track therein to receive the upper edge of the liner which is formed into a bead to hold the liner in place against the water pressure exerted thereon.

A newer greater variety of in ground pool structures and methods are available which provide various degrees of wall strength. Patents in this field include U.S. Pat. Nos. 3,798,857, 3,444,659, 3,823,690, 3,072,921, and 3,511,002. Some pools require the placement of extensive permanent footings of cement disposed about the periphery of the pool wall construction to achieve wall stability and strength.

The primary difficulty of wall strength is two-fold. Firstly, in any pool the wall configuration must be strong enough to resist the great outward pressure exerted by water pressure which can be substantial with increasing depths of water. Secondly, the wall structure must be stable in and of itself such that whenever the pool is empty, the inwardly directed forces required when full will not cause the walls to collapse inwardly.

The present invention includes a novel wall structure to overcome this problem of stability while at the same time being simple, easy and inexpensive to install or relocate. The basic design of both above and below ground pools are well illustrated in U.S. Pat. No. 3,579,665. This patent shows a coping 34 positioned at the top of the inner wall and adapted to receive the top bead of a unitary interior liner 48. U.S. Pat. No. 3,735,427 to Ancewicz shows a "Semi-Portable Swimming Pool" which is partly above and partly below ground to thereby achieve the portability advantages of the present invention. However, the patent to Ancewicz lacks the wall strength and stability disclosed in the present invention. The stability achieved by the "A-frame support" is insufficient except for pools of very limited size.

SUMMARY OF THE INVENTION

The present invention includes an inner wall mounted upon undisturbed earth in the bottom of an excavation and an outer wall mounted upon ground level undisturbed earth around the excavation. A strut is fixedly attached to the inner wall and extends outwardly therefrom to attach to the outer wall itself or to attach to the ground level undisturbed earth adjacent the interior side of the outer wall. The strut thereby prevents the outer wall from collapsing outwardly and the inner wall from caving inwardly because the entire area between the inner and outer wall will be filled with a filler material. The usual filler material will be the earth which has been removed during the process of excavation. The filler material will thereby provide a stable wall structure which resists inward caving when the pool is empty and outward collapsing when the pool is full. Also the strut will maintain the inner and outer wall in a fixed relation from one another.

To provide increased strength the inner wall can be mounted within a rail which is staked into the floor of the excavation. Alternatively the inner wall itself can be staked to the earth as well as can the outer wall or the struts.

A patio assembly is attached to the top edges of the inner and outer wall and extends above the filler material and are mounted into an inner bracket which is attached to the top of the inner wall and are also mounted to an outer bracket attached to the top of the outer wall. These slats are capable of being removed such that plants can be grown in the filler material. Also tables, umbrellas and many other articles of a useful or decorative nature can be mounted in the filler material by the selective removal of specified slats.

The inner bracket can be chosen in the form of coping such that it fixedly mounts upon the top of the inner wall and is adapted to receive the inner edges of the slats while at the same time provides a track along the inner edge thereof. The track is adapted to receive the bead of a unitary vinyl liner. The liner forms the interior pool surface about the inside of the inner wall and along the top surface of the excavation floor.

It is an object of the present invention to provide a relatively portable pool structure with enough wall strength to allow large pool sizes.

It is an object of the present invention to provide a pool structure of simple design capable of installation by unskilled workers.

It is an object of the present invention to provide a partly above and partly below ground pool structure which can be easily and inexpensively modified as to length, width, depth and even location.

It is an object of the present invention to provide a swimming pool construction which required relatively little excavation.

It is an object of the present invention to provide a patio pool structure which makes use of the excavated earth to form a more stable wall structure.

It is an object of the present invention to provide a pool wall having a simple inner and outer portions thereof with the stability and strength being provided by filler material located therebetween.

It is an object of the present invention to provide a patio pool structure of simple construction which has sufficient stability to resist wall collapse during completely full and completely empty pool conditions.

It is an object of the present invention to provide a patio pool capable of a variety of bottom configurations.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective view of an embodiment of the patio pool of the present invention;

FIG. 2 is a side sectional view of a wall structure of the present invention;

FIG. 3 is a side sectional view of the wall structure of another embodiment of the present invention.

DETAILED DESCRIPTION OF THE PREFERRED EMBODIMENTS

Figure 4:
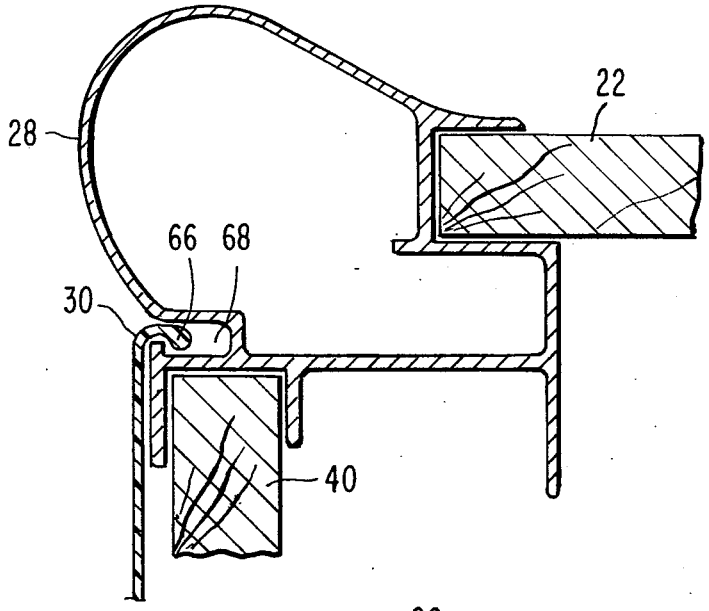
FIG. 4 is a sectional view of coping of the present invention in the installed position.

In an embodiment of the wall structure of the present invention an inner wall 2 is shown mounted into the undisturbed earth 4 on the floor of an excavated area. An outer wall may be mounted into the ground level and unexcavated earth 8 which surrounds the excavation. In this manner wall 2 and wall 6 form a double wall structure around the periphery of the excavation. The inner wall 2 may be chosen of a height such that the upper edge 10 thereof is at substantially the same vertical distance above ground level as wall 6. The volume between the walls can be filled with a filler material 12 which can be various such substances but convenience would dictate the use of the excess earth resulting from the excavation. As the earth settles the pressure is exerted inward on inner wall 2 and outward on outer wall 6, so therefore a strut 14 is fixedly attached to inner wall 2. The other end of strut 14 can be attached to outer wall 6 to thereby form a tie rod 16 such as shown in FIG. 3, or alternatively, the other end of strut 14 can be attached to a stake 18 which affixes the strut 14 to the ground to also stabilize the wall structure. Covering the top of this double wall structure is a patio platform assembly 20 which can comprise a plurality of slats 22, an outer bracket 24 affixed to the top of an outer wall 6 and an inner bracket 26. The inner bracket 26 can be in the form of a coping 28. A unitary vinyl liner 30 is mounted to bracket 26 or to coping 28 and extends downwardly to cover all interior surfaces of inner walls 2 and the entire bottom of the excavation 4.

In particular, the desired depth of the initial excavation can be chosen to conform to the requirement of the particular customer. If a more portable installation is required then the excavation depth will be minimized and the height of outer wall 6 will be maximized. In this configuration the pool structure will take on more of the aspects of an above ground pool. In any installation the total pool depth will be the sum of the excavation depth and the outer wall height. If portability is not a requirement, then a deeper excavation and a shorter height of outer wall 6 can be utilized.

If a deeper excavation is used the strength of the wall structure will be greater. This effect will result from the excavation side wall 32 providing support upon the rear of inner wall 2. Preferably the inner wall 2 is positioned upon undisturbed earthen floor 4 and the periphery thereof immediately adjacent the side wall 32. In this manner the filler material 12 will fill only the narrow distance 36 between wide wall 32 and pool wall 2. Hence, very little packing will occur of the relatively loosely packed filler material 12 located within narrow distance 36. Side walls 32 will provide strong laterial support for inner wall 2 along the lower portion thereof which is where the most extreme outwardly directed water pressures will be realized.

Figure 5:
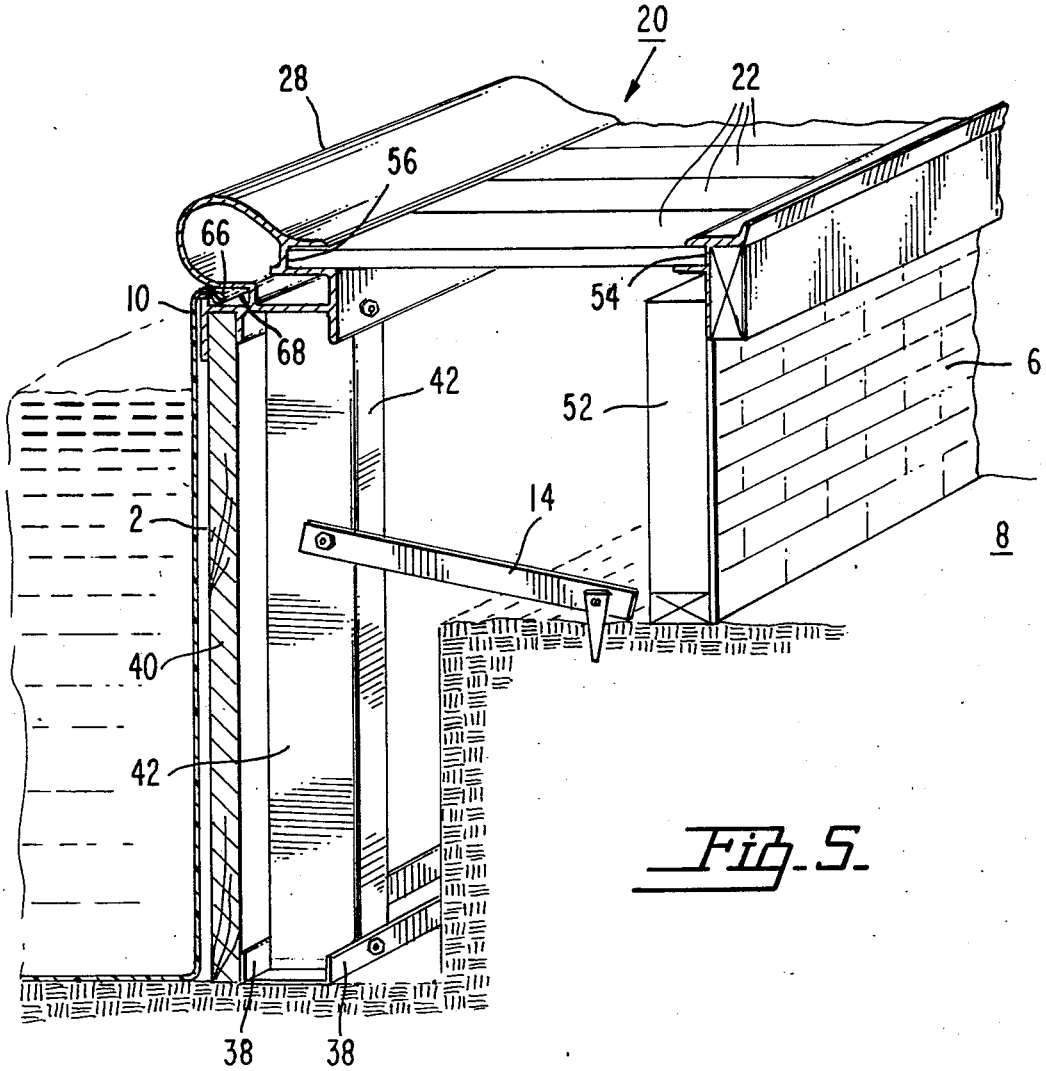
FIG. 5 is a cross-sectional perspective of a wall structure of an embodiment of the present invention.

The stability of inner wall 2 can be further increased by a bottom rail means 38 as best illustrated in FIG. 5. Rail 38 can be fixedly mounted to the periphery of the excavation floor 4 by a stake 44 or other means to thereby provide a channel into which the structure of inner wall 2 can be mounted. The inner wall 2 can be formed with a double structure including an inner panel 40 and an inner panel support 42 which both are adapted to be mounted within the mounting channels of rail member 38. As shown in FIG. 5 the structural strength of wall 2 can be best provided by the inner supports 42 which abut the real surface of inner wall panel 40. Along the top edge of wall 2 an inner bracket 26 or coping 28 provides a mounting surface with channels similarly configured to rail 38. In this manner the inner wall structure 2 can be fixedly held between the coping 28 and the rail 38.

The outer wall 6 is structures similarly to the inner wall 2 with an outer panel 46 and an outer panel support structure 48. Outer wall 6 is subject to much less pressure and as such the outer panel 46 can take the form of a decorative panel such as brick panels 50 or stone panels 52 or any other decorative covering. If the panels are chosen decorative then the outer wall support structure 48 forms a standard wall such as shown at 52.

The basic structural strength and stability of the wall structures of the present invention result from the passive force of the filler material coupled with the interconnections between the inner wall 2 and outer wall 6 via struts 14 or tie rods 16. The connection link between the inner and outer walls is achieved directly by the tie rod connection 16 and indirectly by the strut 14 attachment from inner wall 2 to the ground level undistrubed earth 8. In the latter structure the outer wall is fixedly secured to earth 8 such that the firm link from the outer wall 6 to the inner wall 2 is complete and the outward pressure of filler material 12 is thereby controlled. Since the strength of this wall structure is based upon the passive pressure of the filler material 12, and pool structure is capable of maintaining position during both empty and full pool conditions. The use of the earth removed during excavation as the filler material facilitates speed and ease of installation since removal of the excavated earth from the pool site is not required. Also, should removal or relocation of the pool be desired, the filler material 12 will be immediately adjacent to the excavation site.

The patio platform assembly can be chosen from a variety of available configurations but the use of slats 22 as shown in FIG. 5 illustrates an extremely versatile structure. Slats 22 can be adapted to attach to outer bracket 24 in channel 54 and into channel 56 in coping 28. In this manner the slats 22 will extend traversely across the entire upper surface of the double pool wall structure. The slats can preferably be removed so that plants and bushes such as 58 can be grown within the filler material 12. Also the slats 22 can be removed for any of a variety of amusement, utilitarian or decorative purposes such as placement of an umbrella 60, a skimmer system 62, or pool ladder supports 64.

The surface of the pool interior itself can preferably be provided by a unitary liner 30 of any suitable material such as vinyl. To facilitate installation and maintenance procedures, the liner 30 can be formed with a bead 66 about the entire upper edge thereof. During placement of the liner 30 the bead 66 is inserted into a track or slot 68, which is located at the top of inner wall 2 wuch as within the front edge coping 28 or within inner bracket 26. In this manner, the vinyl liner is pressed downwardly by water pressures etc. the bead 66 will be retained within the track 68 and maintains an effective water seal throughout the usable areas of the pool.

The contour of the bottom surface of the pool can be chosen of any desired contour since lateral support at the depth is being provided by the excavation floor 4 and side walls 32. Also the vinyl liner has the capability to assume any desired configuration.

It is now apparent that this patio pool wall construction has the adaptability and ease of installation of an above ground pool but also has the structural strength of a below ground pool since some of the pool depth is in fact below ground and the portion above ground is strengthened by the stable earth-filled wall structure, which, in turn, facilitates installation. Thus, the strength of the present invention is directly provided by the same elements which allow each of installation.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A patio pool structure comprising (a) an outer wall positioned upon undisturbed ground level earth;

(b) an inner wall positioned upon undisturbed earth within a pool excavation;

(c) a plurality of rigid struts fixedly attached at one end to said inner wall and at the other end to said outer wall for maintaining said inner wall and said outer wall in a fixed position whenever the pool is empty and whenever the pool is full;

(d) a filler material located above ground level between said outer wall and said inner wall and below ground level between said inner wall and the undisturbed earth to fill the space therebetween and provide a stable wall structure; and (e) a patio platform assembly mounted upon the top edges of said inner wall and said outer wall and extending over said filler material.

2. The pool as defined in claim 1 wherein said filler material is earth such as conveniently available from the pool excavation.

3. The pool as defined in claim 1 wherein said outer wall comprises an outer panel facing outward from said pool and an outer panel support abutting the rear surface of said outer panel and maintaining it in a vertical position.

4. The pool as defined in claim 3 wherein the outer surface of said outer panel has an ornamental design thereon.

5. The pool as defined in claim 1 wherein said inner wall is affixed to the bottom surface of an excavation.

6. The pool as defined in claim 5 further comprising a stake means which fixedly attached said inner wall to the bottom surface of an excavation.

7. The pool as defined in claim 1 wherein said inner wall comprises an inner panel extending from the bottom of the excavation to the patio platform assembly, and an inner panel support abutting said inner panel to hold it in a vertical position.

8. The pool as defined in claim 1 further comprising a bottom rail means fixedly mounted into undisturbed earth on the bottom of the excavation and adapted to allow said inner wall to be mounted therein.

9. The pool as defined in claim 1 wherein said patio platform assembly comprises:

a. an outer bracket means fixedly mounted upon the top of said outer wall;

b. an inner bracket means fixedly mounted upon the top of said inner wall;

c. a plurality of patio slats horizontally disposed have said filler material with the inner edges thereof detachably affixed to said inner bracket means and with the outer edges thereof detachably affixed to said outer bracket means.

10. The pool as defined in claim 9 wherein said slats are detachable to facilitate placement of plants and other amusement and utilitarian devices into said filler material.

11. The pool as defined in claim 1 wherein said patio platform assembly includes coping affixed to the top of said inner wall.

12. The pool as defined in claim 1 wherein a track means is positioned along the upper edge of the inner surface of said inner wall.

13. The pool as defined in claim 12 further including a unitary liner extending about the entire surface of the bottom of the excavation inside said inner walls and extending around the complete inner surface of said inner walls.

14. The pool as defined in claim 13 wherein said liner includes a bead means for mounting within said track to securely mount said liner.

15. The pool as defined in claim 13 wherein said unitary liner is vinyl.

* * * * *

UNITED STATES PATENT AND TRADEMARK OFFICE

CERTIFICATE OF CORRECTION

PATENT NO. : 4,120,126

DATED : October 17, 1978

INVENTOR(S) : Robert E. West

It is certified that error appears in the above—identified patent and that said Letters Patent is hereby corrected as shown below:

Column 4, line 32, "structures" should read -- structured --.

Column 5, line 14, "wuch" should read -- such --.

Column 5, line 16, delete "the" and insert therefor -- The --.

Column 6, lines 35 and 36 "disposed have said" should read -- disposed above said --.

Signed and Sealed this

*Thirtieth* Day of *September 1980*

[SEAL]

*Attest:*

SIDNEY A. DIAMOND

*Attesting Officer*

*Commissioner of Patents and Trademarks*